United States Patent [19]

Delia

[11] Patent Number: 4,764,992

[45] Date of Patent: Aug. 23, 1988

[54] DISPENSER HAVING AIR LOCK FORMING MEANS

[75] Inventor: Anthony D. Delia, West Redding, Conn.

[73] Assignee: The Drackett Company, Cincinnati, Ohio

[21] Appl. No.: 148,188

[22] Filed: Jan. 25, 1988

Related U.S. Application Data

[63] Continuation of Ser. No. 886,701, Jul. 18, 1986, abandoned.

[51] Int. Cl.[4] ..... E03D 9/03

[52] U.S. Cl. ..... 4/228

[58] Field of Search ..... 4/227, 228; 222/189; 138/42 X

[56] References Cited

U.S. PATENT DOCUMENTS

| | | | |
|---|---|---|---|
| 1,728,737 | 9/1929 | Stoner | 4/227 |
| 2,815,889 | 12/1957 | Stetz et al. | 138/42 X |
| 3,521,306 | 7/1970 | Jacobs | 4/228 |
| 3,760,433 | 9/1973 | Mallin | 4/228 |
| 4,142,652 | 3/1979 | Platt | 222/189 |
| 4,208,747 | 6/1980 | Dirksing | 4/228 |
| 4,209,864 | 7/1980 | Lindauer | 4/227 X |

*Primary Examiner*—Charles E. Phillips

*Attorney, Agent, or Firm*—Gene Warzecha

[57] ABSTRACT

A toilet tank dispenser for passively isolating the chemical solution in the dispenser from the tank during quiescent periods. The dispenser also provides means for releasing a chemical solution into the water in the tank at a release rate which may be easily varied. The isolation and release rate are achieved and controlled by a porous member inserted in the water flow path of the dispenser.

2 Claims, 3 Drawing Sheets

DISPENSER HAVING AIR LOCK FORMING MEANS

This is a continuing application of application Ser. No. 886,701 filed July 18, 1986, now abandoned.

BACKGROUND OF THE INVENTION

1. Field of the Invention

This invention relates to a novel chemical dispenser for dispensing a predetermined volume of chemical solution into a body of water such as the water in a toilet tank. More particularly, it relates to a dispenser wherein the chemical solution contained in the dispenser is effectively isolated from the body of water during the periods of quiescence. Also, the rate of release of the chemical solution may be controlled by passive means within the dispenser.

2. Description of the Prior Art

There are many types of dispensers for releasing various chemicals such as detergents, disinfectants, etc. into toilet tanks. Depending upon the chemical being utilized there is a need for the dispenser to release the chemical at varying rates. For example, a disinfectant solution to be effective should be released into the tank during the latter portion of the flushing cycle so that the solution is not flushed away. It is desirable in each of these dispensers to provide a means for isolating the chemical solution from the tank during quiescent periods. This prevents unnecessary and wasteful leakage of chemicals into the tank. Dispensers for achieving such isolation of chemicals are generally categorized as passive or active.

Passive dispensers achieve their purpose without moving parts by proper dimensioning of the ports and internal passages of the dispenser. For example, U.S. Pat. No. 4,208,747 (Dirksing), describes a chemical solution dosing dispenser for dispensing the solution into a toilet tank when the toilet is flushed. This device employs a trapped air bubble in the siphon tube to provide an air lock which, in the quiescent period between flushes, isolates the solution in the dispenser from the water in the tank. To form the air bubble Dirksing forms the upper end of his siphon tube into a hook that has a constricted diameter and which forms a pocket in which air can collect during the filling cycle when water from the toilet tank is entering the dispenser.

A disadvantage of the Dirksing device is, however, its manufacture is complicated by the fact that the operation of the device is highly dependent upon its relative internal dimensions.

Active dispensers achieve their isolating function with some type of moving component such as a valve. The valve is designed to open or close at various times in the flushing cycle in order to release the proper amount of chemical solution only during desired portions of the cycle. Active dispensers are necessarily more complex than passive dispensers and are subject to consumer misuse. Such dispensers are also more difficult to produce since manufacturing tolerances of the various parts are more critical than other dispensers and since they require more parts and assembly operations.

One example of an active dispenser is shown in U.S. Pat. No. 3,778,849 (Foley). The Foley device utilizes two valves in conjunction with ports and tubes having predetermined dimensions. The valves open and close in response to varying pressures which change as a function of the water level within the toilet tank.

It is an object of this invention to provide a toilet tank dispenser having a passive means for forming an air lock. It is another object of this invention to provide a toilet tank dispenser for dispensing a chemical solution into the water in the tank at a controlled rate. It is a further object to provide such a dispenser wherein this rate may be varied without changing the dimensions of the dispenser.

SUMMARY OF THE INVENTION

These and other objects of this invention are achieved by a preferred embodiment which comprises, in a dispenser for the releasing of a substance into a toilet tank, said dispenser having an inlet/outlet means for alternately receiving and discharging liquid into and from said dispenser, said dispenser having an air vent tube for communicating the interior of said dispenser to atmospheric pressure, the improvement comprising a porous member situated in the water flow path within said dispenser for limiting the rate of flow of water.

DESCRIPTION OF THE PREFERRED EMBODIMENT

Figure 2:
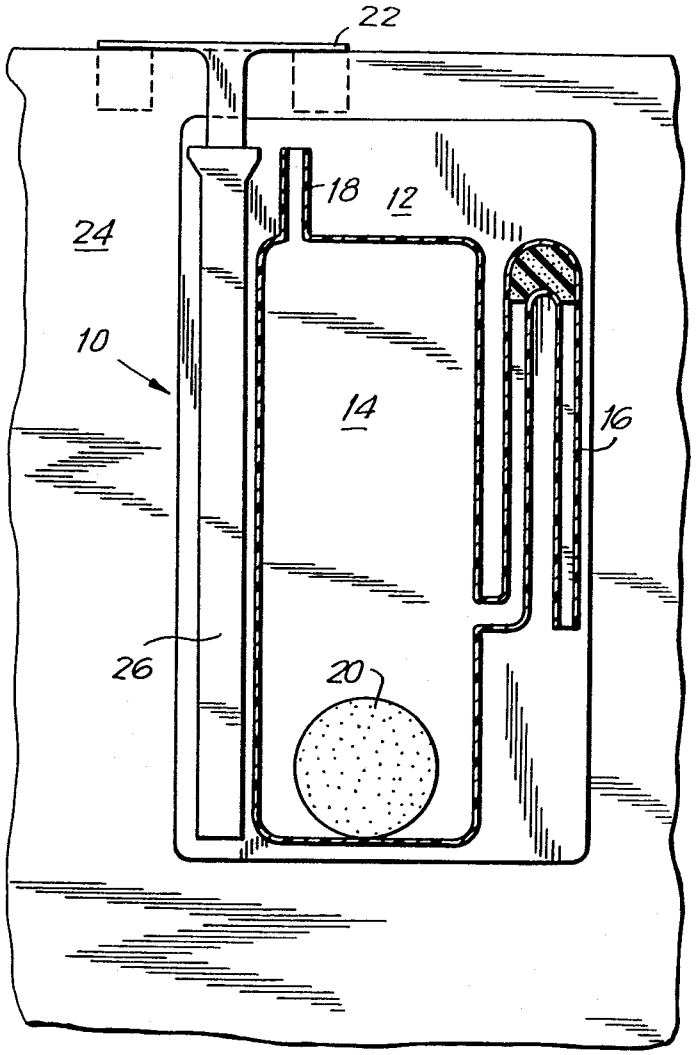
FIG. 2 is a front elevational view in cross-section of the embodiment shown in FIG. 1.
Figure 1:
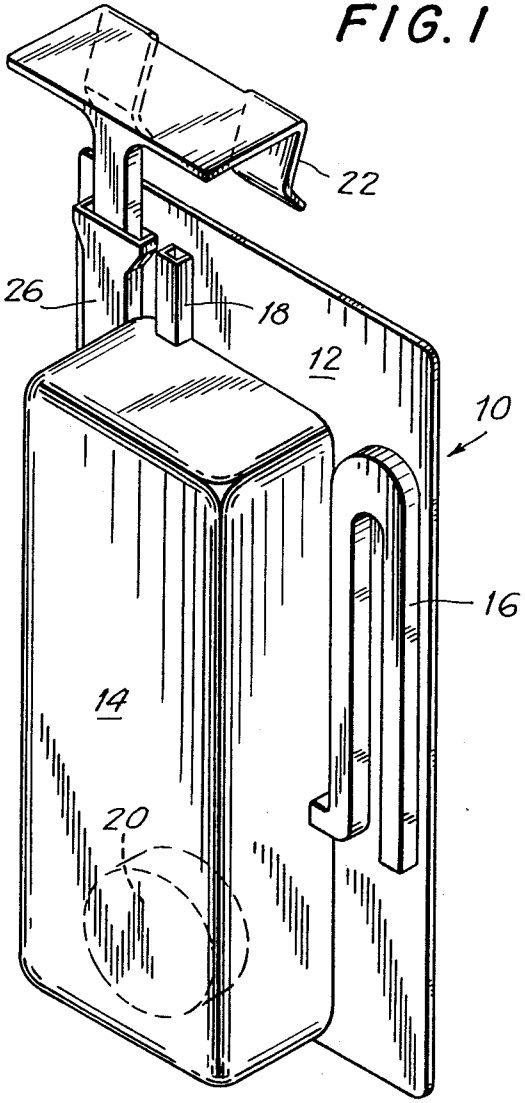
FIG. 1 is a perspective view of one embodiment of the invention showing in phantom a tablet of a predetermined chemical compound in the bottom of the dispenser.

Referring now to FIG. 1, there is shown a diagrammatic perspective view of a dispenser 10 constructed in accordance with the principles of this invention. Dispenser 10 may be constructed with a variety of conventional thermoplastic molding techniques using any suitable materials compatible with the chemicals to be used within the dispenser. Dispenser 10 includes a base or support 12 which forms the base upon which the remaining structures of the dispenser are molded. Dispenser 10 includes a container 14 having an inlet/outlet siphon tube 16 and a vent tube 18. Tablet 20 may be any one of several conventional disinfectant materials generally used within toilet tanks and designed to slowly dissolve to provide the proper concentration of solution within container 14. Dispenser 10 is also provided with a hook 22 for hanging the dispenser within the interior of a toilet tank 24. Hook 22 may be adjusted vertically within sliding channel 26 in order to place the base 12 and all components associated therewith at the proper elevation within tank 24. It will be understood that, while dispenser 10 is shown as a siphon type device, the invention is equally applicable to gravity fed devices.

Figure 5:
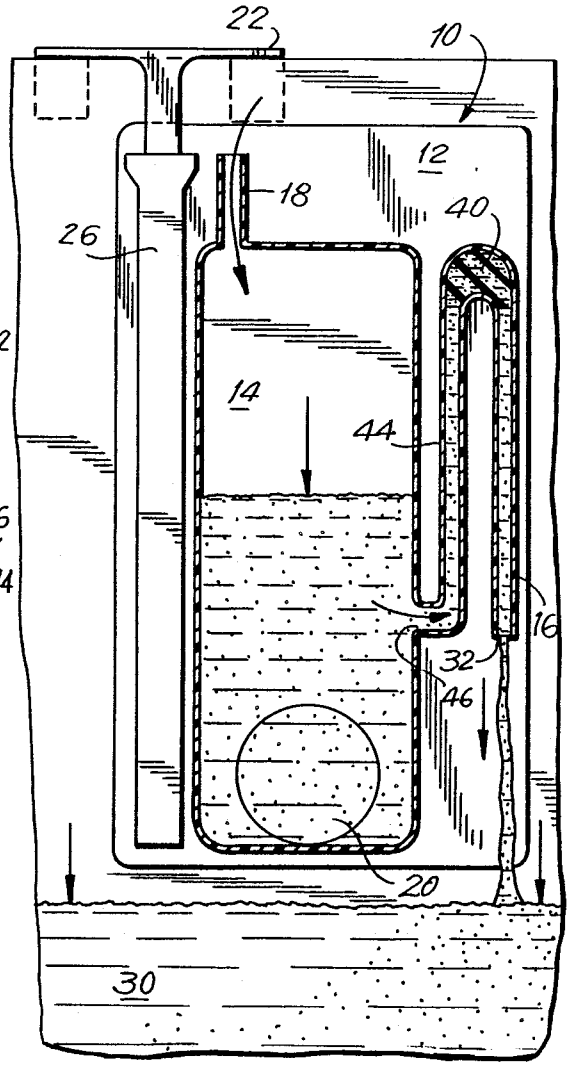
FIG. 5 is a view of FIG. 2 during the discharge or flushing cycle.
Figure 4:
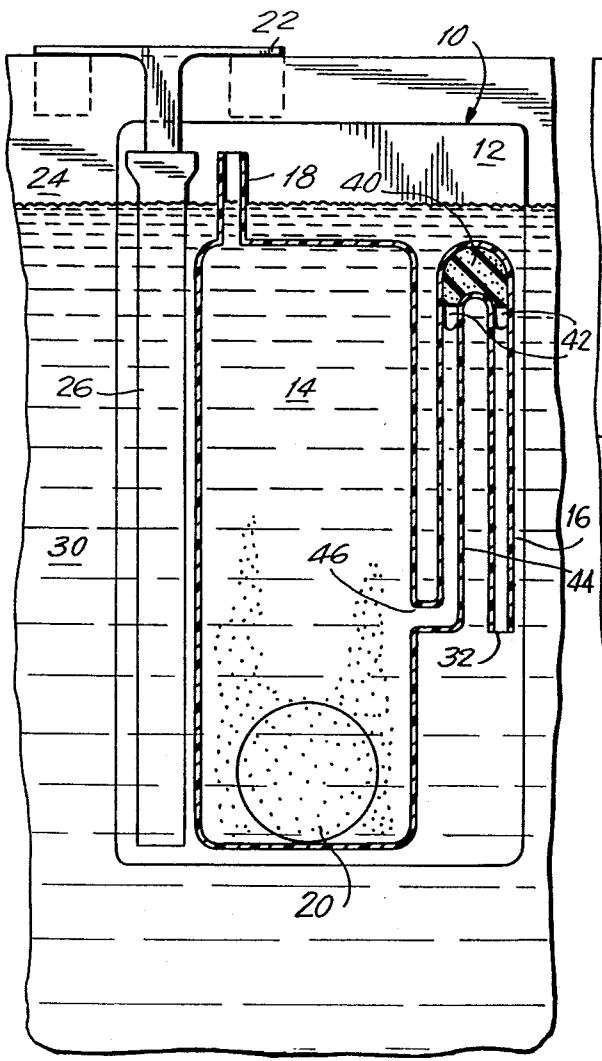
FIG. 4 is a view of FIG. 2 during the quiescent period.
Figure 3:
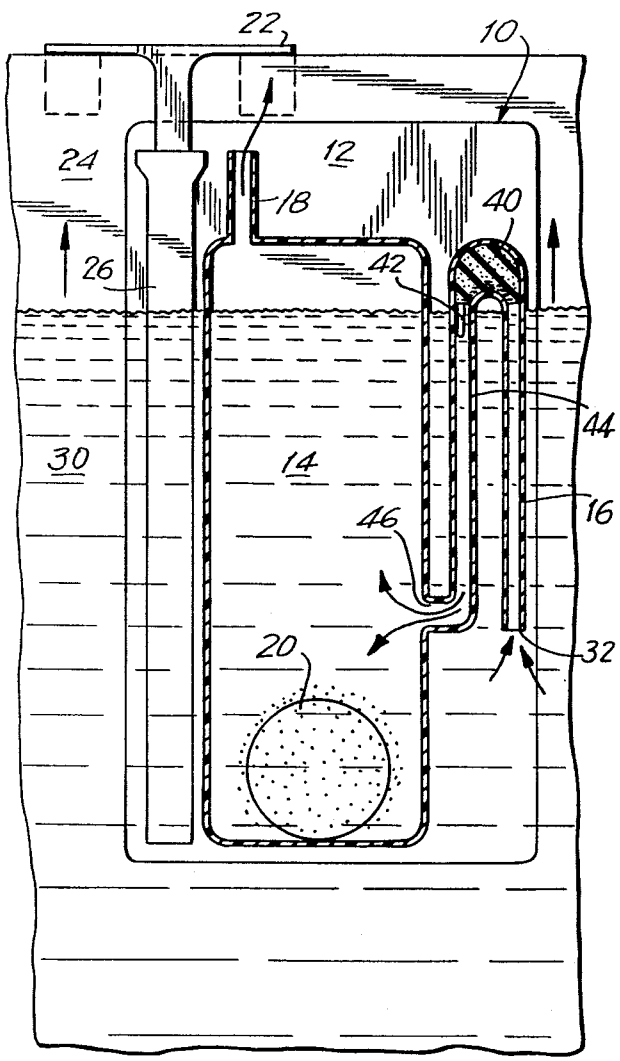
FIG. 3 is a view of FIG. 2 during a portion of the filling cycle.

The structure of the invention embodied within dispenser 10 is best understood by a description of the operation of the invention as depicted in FIGS. 3, 4 and 5. FIG. 3 shows the dispenser 10 during the filling cycle with the level of water 30 rising in tank 24. As the water passes upwardly past the end 32 of inlet/outlet tube 16, water will continue rising in tube 16 thereby pushing the air within the interior of container 14 out the vent tube 18. As will be noted by reference to the drawings, the U-shaped portion of inlet/outlet siphon tube 16 is filled with a porous material 40 which permits passage of the air and water, although at a decreased rate. As will be understood by those skilled in the art, this causes the water entering siphon tube 16 to trickle over into leg 44 and necessarily produces an air bubble 42 in the top of siphon tube 16. As the water level continues to rise in tank 24, the water level within container 14 will also rise until, as shown in FIG. 4, a quiescent period is reached where the water level in the tank equals the water level in the vent tube 18. During this quiescent period the air bubble 42, no longer being forced to one side of porous member 40 by the pressure of in-flowing water, will stabilize at the top of the U-shaped portion of inlet/outlet siphon tube 16 so that a portion of air bubble 42 appears in both the upward and downward legs of tube 16, thus isolating the interior of the dispenser from the tank.

During the flushing part of the cycle as depicted in FIG. 5, the level of water 30 in the tank drops faster than the level of solution in container 14. The rate at which container 14 empties is restricted by the size of inlet/outlet siphon tube 16 and by the density of porous member 40. The difference in these rates necessarily results in container 14 releasing most of its contents into tank 24 after the initial flushing stage so that most of the chemical solution is not needlessly flushed away. The solution in container 14 continues to be siphoned through tube 16 so long as the level of water in the tank is below port 32 and the level in container 14 is above inlet port 46. The remaining solution in the bottom of container 14 below inlet port 46 will remain in a concentrated state to enable rapid recovery of the dispenser 10 in preparation for the next flushing cycle.

Figure 8:
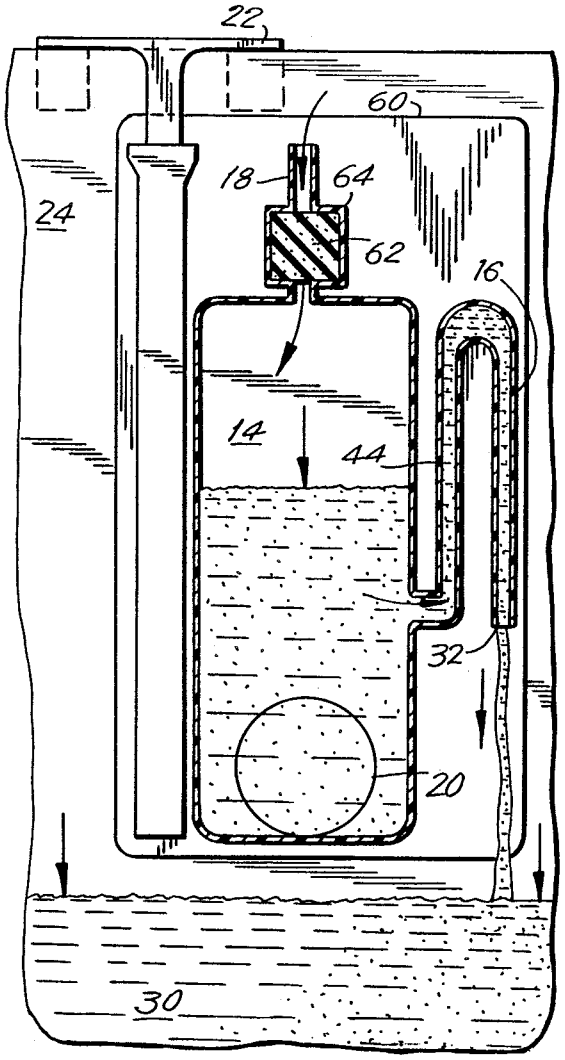
FIG. 8 is a view of FIG. 7 during a later portion of the discharge cycle.
Figure 7:
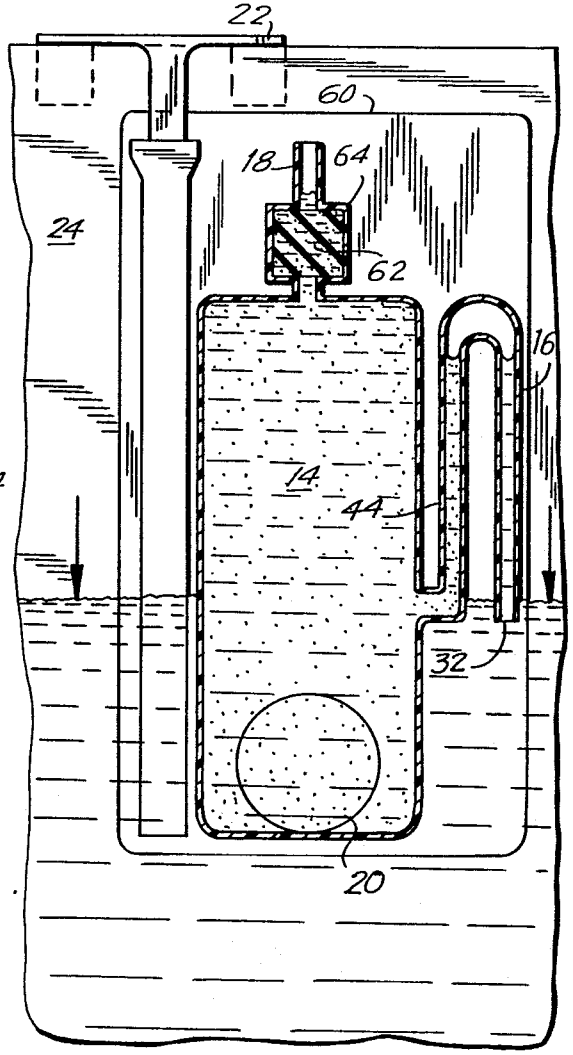
FIG. 7 is a view of FIG. 6 during the initial portion of the discharge cycle.
Figure 6:
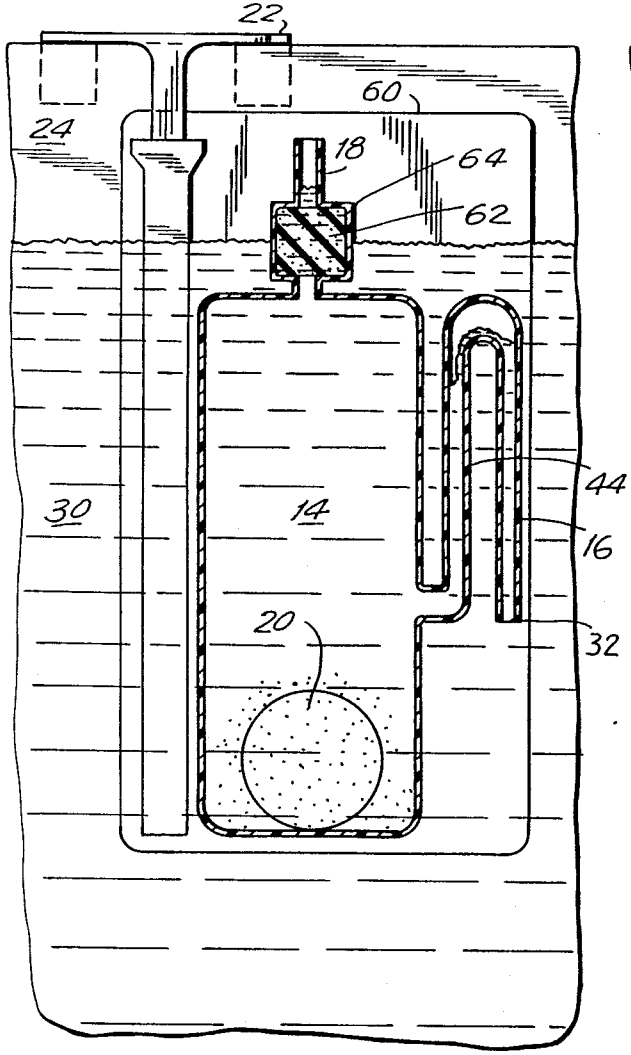
FIG. 6 is an elevational view in cross-section of an alternative embodiment of the invention during a portion of the filling cycle.

Referring now to FIG. 6, an alternative embodiment of the invention is shown by dispenser 60 wherein parts similar to those shown in FIGS. 1 through 5 are given the same numbers in FIGS. 6, 7 and 8. It will be noted that the major distinction between the embodiment of FIGS. 3, 4 and 5 and FIGS. 6, 7 and 8 is that the latter does not include any porous material in the inlet/outlet siphon tube 16 but rather includes porous material 62 in an enlarged portion 64 of vent tube 18.

It will be understood that during the filling portion of the cycle shown in FIG. 6, water will enter port 32 of inlet/outlet siphon tube 16 and push air and water through vent tube 18, trickling into downward leg 44 until the quiescent state (not shown) is obtained during which an isolating air lock is provided in the top of siphon tube 16. During the initial part of the flushing cycle shown in FIG. 7, the water level in tank 24 will drop faster than the water level in container 14 because of the resistance provided by porous member 62. Once the water level has dropped below the porous member 62, the rate at which the chemical solution is siphoned from container 14 will increase significantly. It will be understood that this increase in release rate occurs well after the initial period of the flushing cycle so that most of the chemical solution remains in the tank instead of being flushed away.

While the porous/inlet embodiment shown in FIGS. 3, 4, and 5 results in a steady rate of discharge of the contents of container 14, the porous/vent embodiment shown in FIGS. 6, 7 and 8 results in a slow discharge rate up until a predetermined point in the cycle at which the rate is suddenly increased. Both embodiments, however, passively provide an air lock without the need to be concerned about the dimensions of siphon tube 16. Furthermore, the release rate of each embodiment may be easily altered, without changing the dimensions of the dispenser, by merely utilizing different porous materials.

It will be understood by those skilled in the art that numerous improvements and modifications may be made to the preferred embodiment of the invention disclosed herein without departing from the spirit and scope hereof.

What is claimed is:

1. A dispenser for the controlled-rate release of a substance into a toilet tank, said dispenser having an inlet/outlet conduit means extending downwardly away from an inverted U-shaped portion for alternately receiving and discharging liquid into and form said dispenser, said dispenser having an air vent tube for communicating the interior of said dispenser to atmospheric pressure and a porous member situated within and filling said U-shaped portion for limiting the flow of water therethrough.

2. An apparatus according to claim 1 wherein said porous member produces an air bubble intermediate the interior of said dispenser and the liquid in said tank in order to prevent fluid communication therebetween during static periods.

* * * * *